US012774073B2

(12) United States Patent
Kamiya et al.

(10) Patent No.: US 12,774,073 B2
(45) Date of Patent: Oct. 27, 2026

(54) SHIP CONTROL SYSTEM, SHIP CONTROL DEVICE, SHIP CONTROL METHOD, AND A NON-TRANSITORY COMPUTER READABLE MEDIUM

(71) Applicant: NHK SPRING Co., Ltd., Yokohama (JP)

(72) Inventors: Takafumi Kamiya, Yokohama (JP); Marino Sato, Yokohama (JP); Jun Tokushige, Yokohama (JP); Masato Shirao, Yokohama (JP)

(73) Assignee: NHK SPRING CO., LTD., Yokohama (JP)

( * ) Notice: Subject to any disclaimer, the term of this patent is extended or adjusted under 35 U.S.C. 154(b) by 51 days.

(21) Appl. No.: 18/391,046

(22) Filed: Dec. 20, 2023

(65) Prior Publication Data

US 2024/0166324 A1 May 23, 2024

Related U.S. Application Data

(63) Continuation of application No. PCT/JP2022/021919, filed on May 30, 2022.

(30) Foreign Application Priority Data

Jun. 24, 2021 (JP) ..... 2021-104976

(51) Int. Cl.
*B63H 21/21* (2006.01)
*B63H 25/42* (2006.01)
*B63H 25/02* (2006.01)

(52) U.S. Cl.
CPC ..... *B63H 21/21* (2013.01); *B63H 25/42* (2013.01); *B63H 2025/026* (2013.01)

(58) Field of Classification Search
None
See application file for complete search history.

(56) References Cited

U.S. PATENT DOCUMENTS 10,640,190 B1 5/2020 Gonring
2008/0171479 A1* 7/2008 Hallenstvedt ..... B63H 21/22 440/1

(Continued)

FOREIGN PATENT DOCUMENTS

EP 2343236 A1 7/2011
JP 2011140272 A 7/2011

(Continued)

OTHER PUBLICATIONS

EPO Extended European Search Report for corresponding EP Application No. 22828154.9; Issued Oct. 7, 2024.

(Continued)

*Primary Examiner* — Redhwan K Mawari
*Assistant Examiner* — Nada Mahyoob Alqaderi
(74) *Attorney, Agent, or Firm* — CANTOR COLBURN LLP

(57) ABSTRACT

A ship control system that includes a ship and an input device, in which the ship includes an actuator having a function of generating thrust for the ship and a function of generating a moment in the ship, a first operation unit configured to receive an input operation from a ship operator, and a ship control device configured to activate the actuator, the input device includes a second operation unit configured to receive an input operation from the ship operator, the ship control device includes a first operation mode and a second operation mode, a moment is generated in the ship on the basis of the input operation received by the first operation unit in the first operation mode, the actuator is activated on the basis of the input operation received by the second operation unit in the second operation mode, and (Continued)

the ship control device executes bow direction feedback control of the ship on the basis of a deviation between a target bow direction and an actual bow direction of the ship in the second operation mode.

16 Claims, 7 Drawing Sheets

(56) References Cited

U.S. PATENT DOCUMENTS

2011/0166724 A1* 7/2011 Hiramatsu ..... B63H 25/42 702/85
2012/0266799 A1* 10/2012 Keuning ..... B63B 1/06 701/21
2014/0046515 A1* 2/2014 Mizutani ..... B63H 20/08 701/21
2015/0166159 A1* 6/2015 Inoue ..... B63H 20/12 440/53
2018/0335780 A1* 11/2018 Stevens ..... B63C 9/0011
2019/0361446 A1* 11/2019 Ward ..... B63H 25/42
2020/0062365 A1* 2/2020 Anderson ..... H04W 12/068

FOREIGN PATENT DOCUMENTS

JP 2014034269 A 2/2014
JP 2015116847 A 6/2015

OTHER PUBLICATIONS

International Search Report for International Application No. PCT/JP2022/021919; Mailing Date, Jul. 19, 2022.

* cited by examiner

STEERING
TARGET BOW DIRECTION
ACTUAL BOW DIRECTION
11
TURNING STARTING
TIME t1 n DEGREES
TARGET BOW DIRECTION
ACTUAL BOW DIRECTION
11
TIME t2

2n DEGREES
TARGET BOW DIRECTION
ACTUAL BOW DIRECTION
11
TIME t3

3n DEGREES
TARGET BOW DIRECTION
ACTUAL BOW DIRECTION
11
TIME t4

TARGET BOW DIRECTION
ACTUAL BOW DIRECTION
11
DIRECTION HOLDING
TIME t11

TARGET DIRECTION SETTING
ACTUAL BOW DIRECTION
TARGET BOW DIRECTION
11
FORWARD MOVING STARTING
TIME t12

ACTUAL BOW DIRECTION
TARGET BOW DIRECTION
11
MOVING FORWARD
TIME t13

STEERING
THRUST

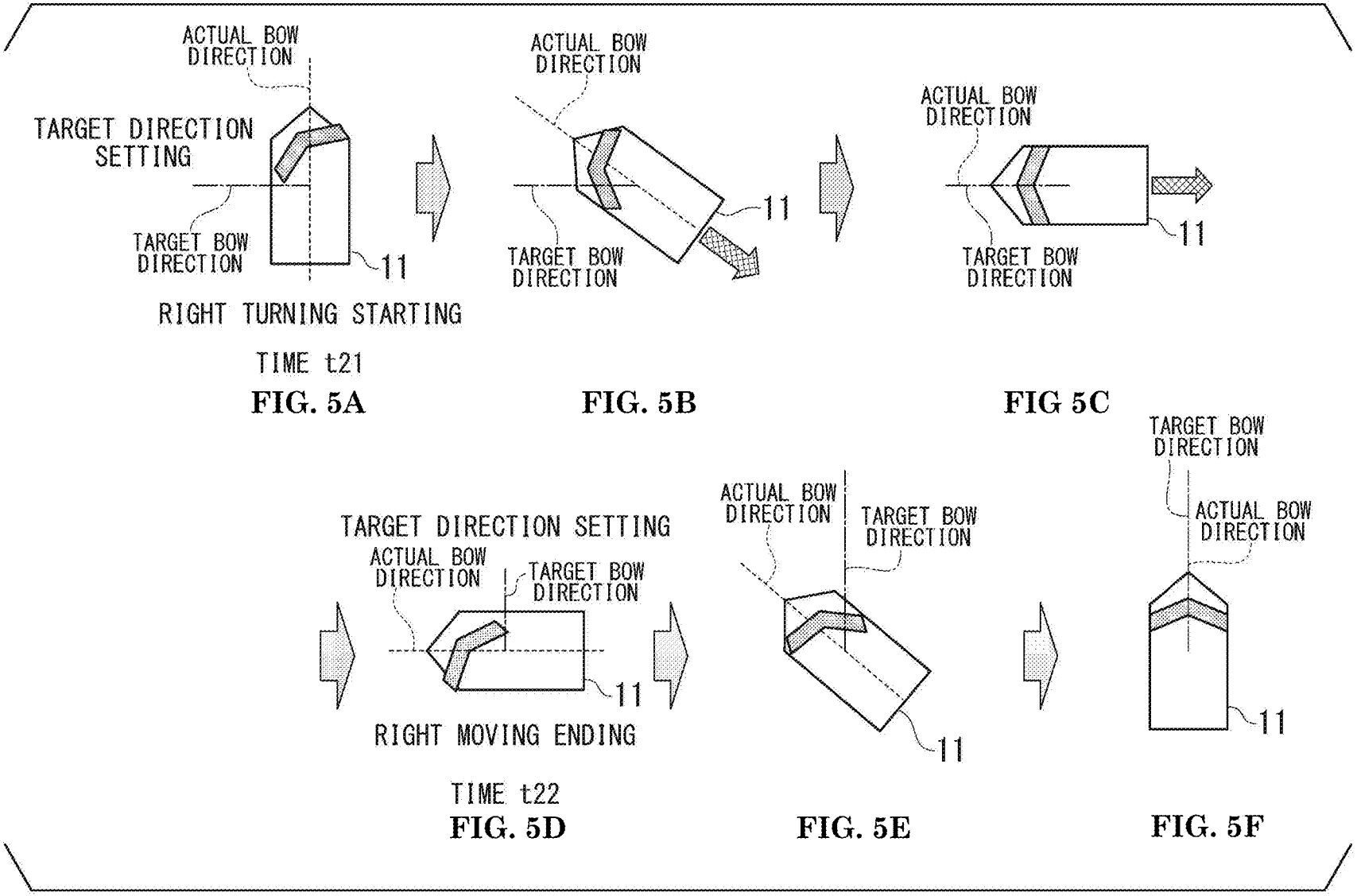
ACTUAL BOW DIRECTION
TARGET DIRECTION SETTING
TARGET BOW DIRECTION
11
RIGHT TURNING STARTING
TIME t21
FIG. 5A
ACTUAL BOW DIRECTION
TARGET BOW DIRECTION
11
FIG. 5B
ACTUAL BOW DIRECTION
TARGET BOW DIRECTION
11
FIG 5C
TARGET BOW DIRECTION
ACTUAL BOW DIRECTION
11
FIG. 5F
ACTUAL BOW DIRECTION
TARGET BOW DIRECTION
11
FIG. 5E
TARGET DIRECTION SETTING
ACTUAL BOW DIRECTION
TARGET BOW DIRECTION
11
RIGHT MOVING ENDING
TIME t22
FIG. 5D

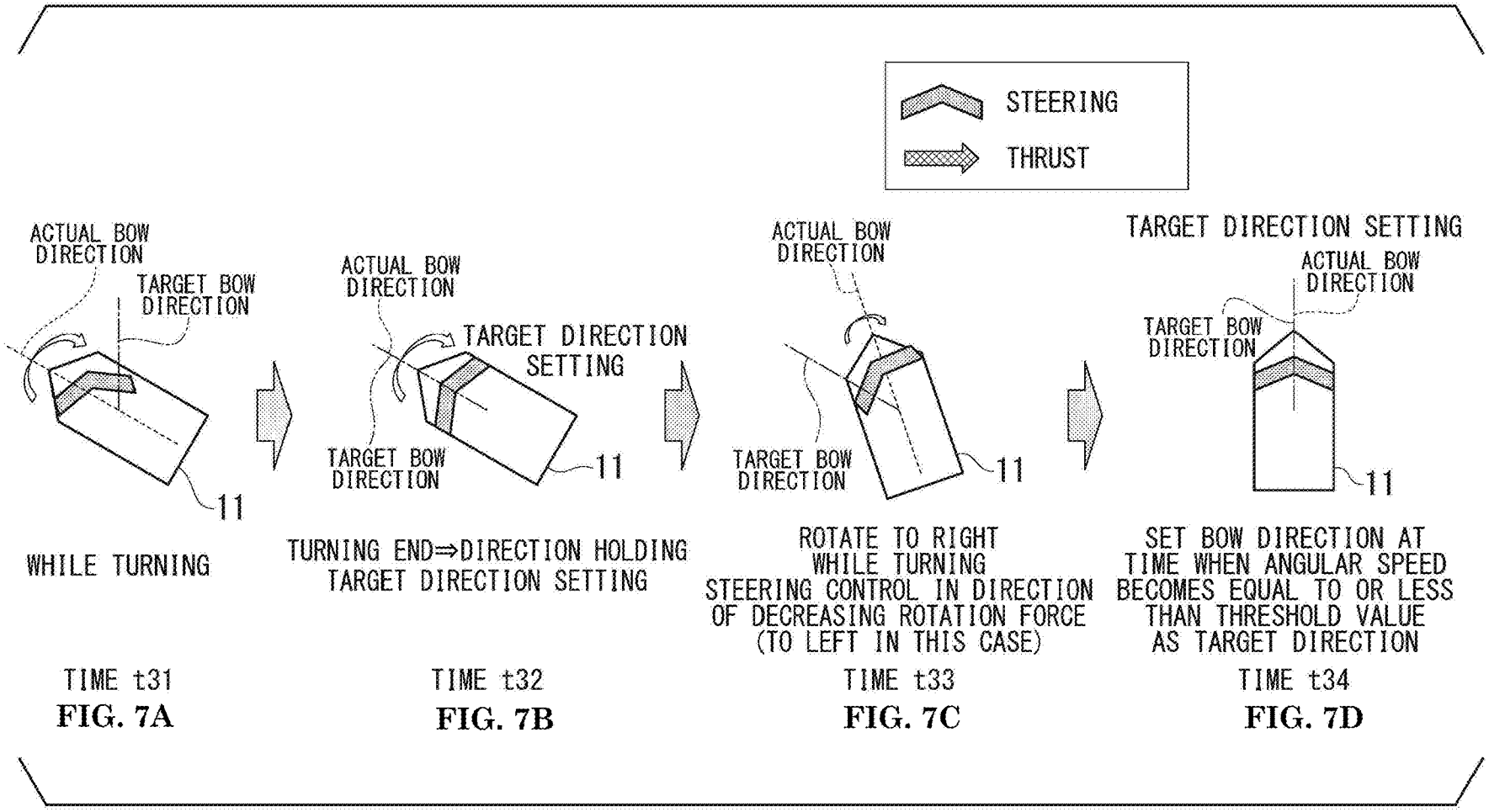
STEERING
THRUST
ACTUAL BOW DIRECTION
TARGET BOW DIRECTION
11
WHILE TURNING
TIME t31
FIG. 7A
TARGET DIRECTION SETTING
TURNING END⇒DIRECTION HOLDING
TARGET DIRECTION SETTING
TIME t32
FIG. 7B
ROTATE TO RIGHT
WHILE TURNING
STEERING CONTROL IN DIRECTION
OF DECREASING ROTATION FORCE
(TO LEFT IN THIS CASE)
TIME t33
FIG. 7C
SET BOW DIRECTION AT
TIME WHEN ANGULAR SPEED
BECOMES EQUAL TO OR LESS
THAN THRESHOLD VALUE
AS TARGET DIRECTION
TIME t34
FIG. 7D

SHIP CONTROL SYSTEM, SHIP CONTROL DEVICE, SHIP CONTROL METHOD, AND A NON-TRANSITORY COMPUTER READABLE MEDIUM

CROSS REFERENCES TO RELATED APPLICATIONS

This application is a continuation under 35 U.S.C. § 120 of PCT/JP2022/021919, filed May 30, 2022, which is incorporated herein by reference, and which claimed priority to Japanese Application No. 2021-104976, filed Jun. 24, 2021. The present application likewise claims priority under 35 U.S.C. § 119 to Japanese Application No. 2021-104976, filed Jun. 24, 2021, the entire content of which is also incorporated herein by reference.

TECHNICAL FIELD

The present invention relates to a ship control system, a ship control device, a ship control method, and a non-transitory computer readable medium.

BACKGROUND ART

Conventionally, a personal watercraft (PWC) auto-return system is known (for example, refer to Patent Document 1). The PWC auto-return system described in Patent Document 1 includes a user device and an autopilot unit disposed within the PWC. The user device includes a passenger position determination unit, a user interface, and a communication unit. In the technology described in Patent Document 1, if a passenger carrying a user device leaves the PWC (falls into the water), the PWC receives a request from the user interface and proceeds to a position of the user device by automatic maneuvering.

Incidentally, Patent Document 1 does not specifically describe how a bow direction of the PWC is controlled when an actuator of the PWC is activated on the basis of an input operation from a user received by a user device. For this reason, there is a possibility that the bow direction of the PWC cannot be appropriately controlled when the PWC is operated remotely via a user device according to the technology described in Patent Document 1.

CITATION LIST

Patent Literature

Patent Literature 1
United States patent Application, Publication No. 2018/0335780

SUMMARY OF INVENTION

Technical Problem

In view of the problems described above, an object of the present invention is to provide a ship control system, a ship control device, a ship control method, and a non-transitory computer readable medium that can appropriately control a bow direction of a ship when the ship is operated.

Solution to Problem

According to one aspect of the present invention, there is a ship control system that includes a ship and an input device, in which the ship includes an actuator having a function of generating thrust for the ship and a function of generating a moment in the ship, a first operation unit configured to receive an input operation from a ship operator, and a ship control device configured to activate the actuator, the input device includes a second operation unit configured to receive an input operation from the ship operator, the ship control device includes a first operation mode and a second operation mode, a moment is generated in the ship on the basis of the input operation received by the first operation unit in the first operation mode, the actuator is activated on the basis of the input operation received by the second operation unit in the second operation mode, and the ship control device executes bow direction feedback control of the ship on the basis of a deviation between a target bow direction and an actual bow direction of the ship in the second operation mode.

According to another aspect of the present invention, there is a ship control device that is included in a ship including an actuator that has a function of generating thrust of the ship and a function of generating a moment in the ship, and a first operation unit configured to receive an input operation from a ship operator, in which the ship control device includes a first operation mode and a second operation mode, a moment is generated in the ship on the basis of an input operation received by the first operation unit in the first operation mode, the actuator is activated on the basis of an input operation received by the second operation unit included in an input device in the second operation mode, and the ship control device executes bow direction feedback control of the ship on the basis of a deviation between a target bow direction and an actual bow direction of the ship in the second operation mode.

According to still another aspect of the present invention, there is a ship control method of controlling a ship including an actuator that has a function of generating thrust of the ship and a function of generating a moment in the ship, and a first operation unit configured to receive an input operation from a ship operator, including a first operation step in which a moment is generated in the ship on the basis of an input operation received by the first operation unit, and a second operation step in which the actuator is activated on the basis of an input operation received by the second operation unit included in an input device, in which bow direction feedback control of the ship is executed on the basis of a deviation between a target bow direction and an actual bow direction of the ship in the second operation step.

According to still another aspect of the present invention, there is a non-transitory computer readable medium for causing a computer installed in a ship including an actuator that has a function of generating thrust of the ship and a function of generating a moment in the ship, and a first operation unit configured to receive an input operation from a ship operator to execute a first operation step in which a moment is generated in the ship on the basis of an input operation received by the first operation unit, and a second operation step in which the actuator is activated on the basis of an input operation received by the second operation unit included in an input device, in which bow direction feedback control of the ship is executed on the basis of a deviation between a target bow direction and an actual bow direction of the ship in the second operation step.

Advantageous Effects of Invention

According to the present invention, it is possible to provide a ship control system, a ship control device, a ship control method, and a non-transitory computer readable medium that can appropriately control a bow direction of a ship when the ship is operated.

BRIEF DESCRIPTION OF DRAWINGS

FIG. 5A to FIG. 5F are diagrams for describing an example of the control by the ship control device when a right moving operation unit of the second operation unit of the input device has received an input operation from the ship operator to move the ship to the right (move it laterally in a right direction).

FIG. 7A to FIG. 7D are diagrams for describing an example of the control by the ship control device when a right turning operation unit of the second operation unit of the input device of a ship control system of a second embodiment has received an input operation from the ship operator to cause a ship to circle to the right or to turn around to the right.

DESCRIPTION OF EMBODIMENTS

First Embodiment

Hereinafter, a first embodiment of a ship control system, a ship control device, a ship control method, and a non-transitory computer readable medium of the present invention will be described below.

Figure 1:
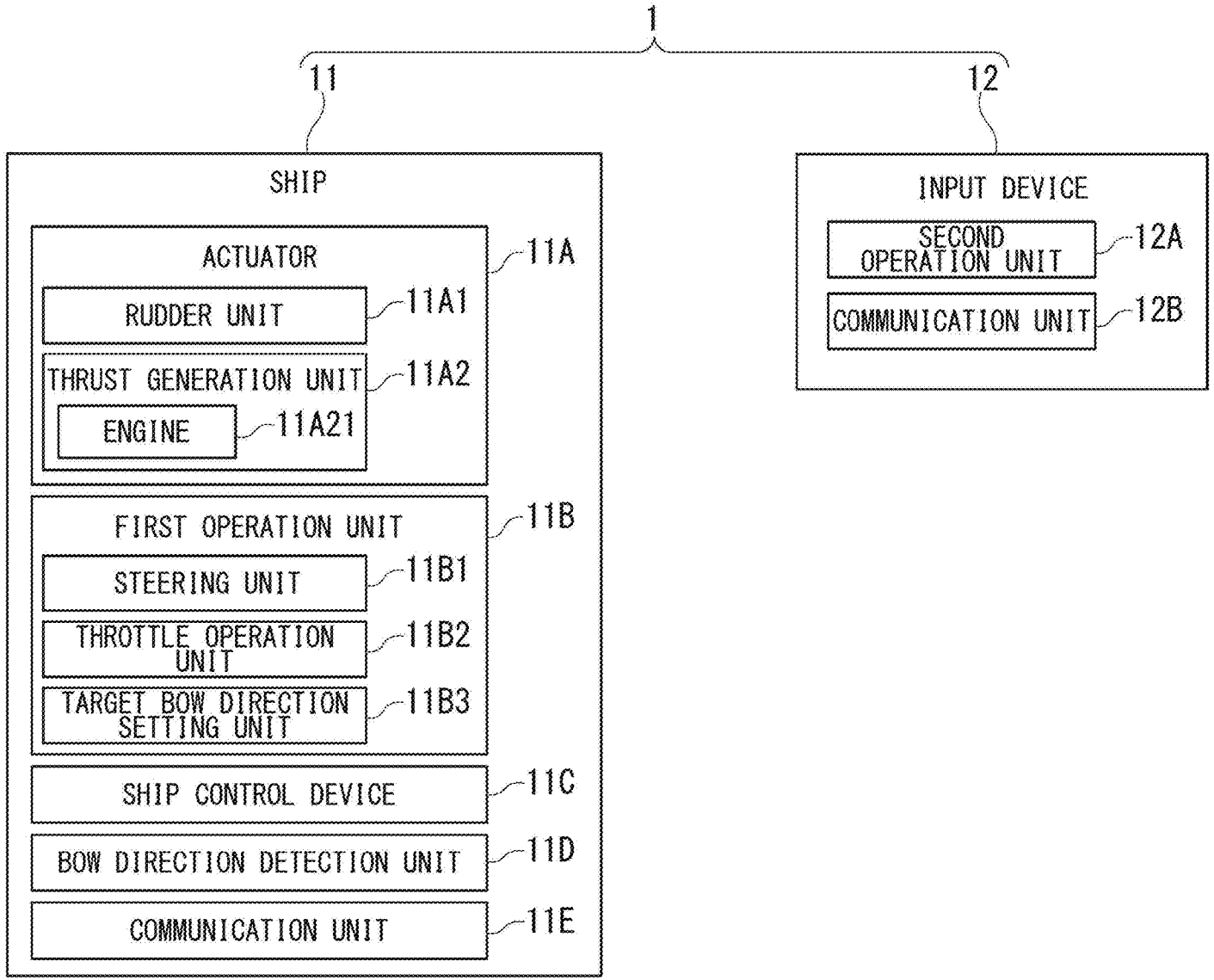
FIG. 1 is a diagram which shows an example of a ship control system to which a ship control device according to a first embodiment is applied.

FIG. 1 is a diagram which shows an example of a ship control system 1 to which a ship control device 11C according to the first embodiment is applied.

In the example shown in FIG. 1, the ship control system 1 includes a ship 11 and an input device 12 (for example, a communication device separate from the ship 11). The ship 11 of the first embodiment is, for example, a personal watercraft (PWC, personal watercraft) having functions similar to those of a PWC described in FIG. 1 of Japanese Patent No. 5196649. The ship 11 includes an actuator 11A, a first operation unit 11B, a ship control device 11C, a bow direction detection unit 11D, and a communication unit 11E.

The actuator 11A includes a rudder unit 11A1 and a thrust generation unit 11A2. The rudder unit 11A1 has a function of generating a moment in the ship 11. The thrust generation unit 11A2 has a function of generating thrust for the ship 11. The thrust generation unit 11A2 includes an engine 11A21.

In detail, the actuator 11A includes, for example, an engine, a nozzle, a deflector, a trim actuator, a bucket, a bucket actuator, and the like described in FIG. 1 of Japanese Unexamined Patent Application, First Publication No. 2019-171925.

The first operation unit 11B receives an input operation from a ship operator (specifically, a ship operator on board the ship 11). The first operation unit 11B includes, for example, a steering unit 11B1, a throttle operation unit 11B2, and a target bow direction setting unit 11B3. The steering unit 11B1 receives an input operation from a ship operator to activate the rudder unit 11A1. The throttle operation unit 11B2 receives an input operation from a ship operator to activate the thrust generation unit 11A2. The target bow direction setting unit 11B3 sets a target bow direction of the ship 11. The target bow direction setting unit 11B3 sets the target bow direction of the ship 11 according to the input operation from the ship operator (for example, an operation of turning on a switch (not shown)).

Specifically, the first operation unit 11B is configured similarly to, for example, a steering handle device shown in FIG. 1 of Japanese Patent No. 5196649, a steering unit shown in FIG. 1 of Japanese Unexamined Patent Application, First Publication No. 2019-171925, and the like.

The ship control device 11C performs control of operating the actuator 11A on the basis of the input operation from the ship operator received by the first operation unit 11B, and the like.

The bow direction detection unit 11D detects an actual bow direction of the ship 11. The bow direction detection unit 11D includes, for example, a direction sensor. The direction sensor calculates the actual bow direction of the ship 11 by using, for example, geomagnetism.

In another example, the direction sensor may be a device (gyro compass) in which a north-pointing device and a vibration damping device are added to a gyroscope that rotates at high speed so that it always indicates the north.

In still another example, the direction sensor may be a Global Positioning system (GPS) compass that includes a plurality of GPS antennas and calculates the bow direction based on a relative positional relationship of the plurality of GPS antennas.

In the example shown in FIG. 1, the communication unit 11E communicates with the input device 12.

The input device 12 is carried by the ship operator described above. The input device 12 includes a second operation unit 12A and a communication unit 12B. The second operation unit 12A receives an input operation from the ship operator, for example, outside the ship 11 or the like. The communication unit 12B communicates with the communication unit 11E of the ship 11.

Figure 2:
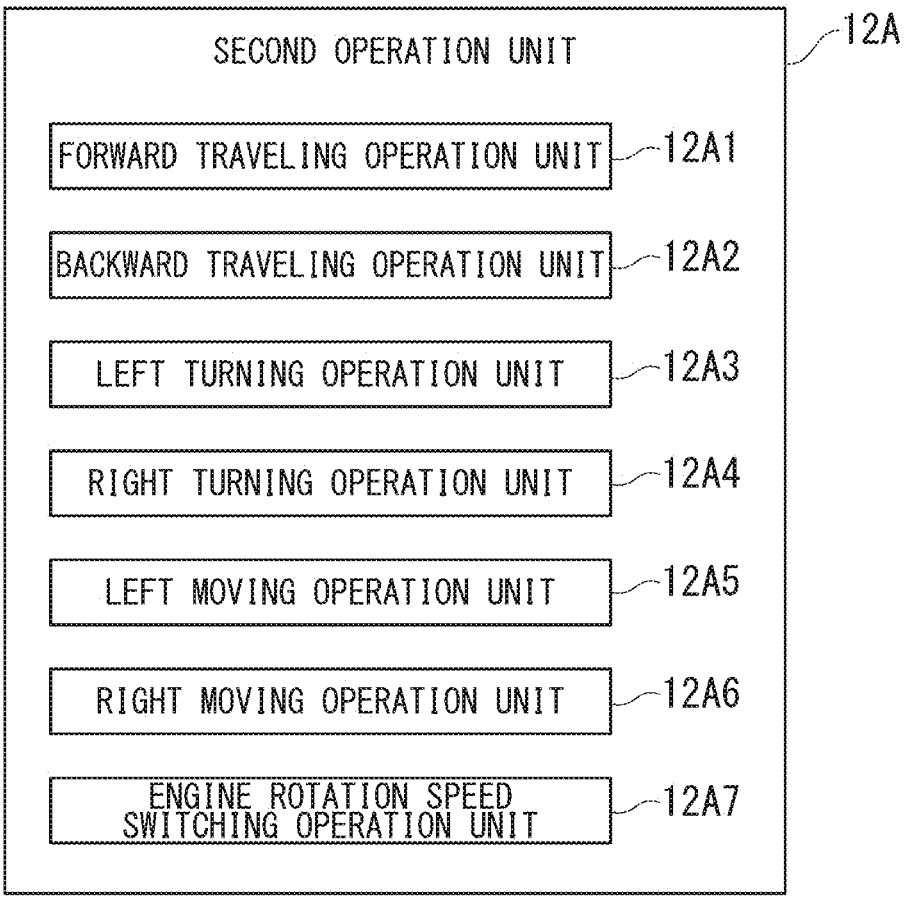
FIG. 2 is a diagram which shows an example of a second operation unit.

FIG. 2 is a diagram which shows an example of the second operation unit 12A.

In the example shown in FIG. 2, the second operation unit 12A includes a forward traveling operation unit 12A1, a backward traveling operation unit 12A2, a left turning operation unit 12A3, a right turning operation unit 12A4, a left moving operation unit 12A5, a right moving operation unit 12A6, and an engine rotation speed switching operation unit 12A7.

The forward traveling operation unit 12A1 receives an input operation from the ship operator to move the ship 11 forward (specifically, for example, an input operation from the ship operator outside the ship 11). When the forward traveling operation unit 12A1 has received the input operation from the ship operator to move the ship 11 forward, the communication unit 12B transmits to the ship 11 the input operation from the ship operator to move the ship 11 forward, which is received by the forward traveling operation unit 12A1. The ship control device 11C of the ship 11 activates the actuator 11A to move the ship 11 forward on the basis of the input operation from the ship operator to move the ship 11 forward, which is received by the forward traveling operation unit 12A1.

The backward traveling operation unit 12A2 receives an input operation from the ship operator to move the ship 11 backward. When the backward traveling operation unit 12A2 has received the input operation from the ship operator to move the ship 11 backwards, the communication unit 12B transmits to the ship 11 the input operation from the ship operator to move the ship 11 backwards, which has been received by the backward traveling operation unit 12A2. The ship control device 11C of the ship 11 activates the actuator 11A to move the ship 11 backward on the basis of the input operation from the ship operator to move the ship 11 backward, which has been received by the backward traveling operation unit 12A2.

The left turning operation unit 12A3 receives an input operation from the ship operator to cause the ship 11 to circle to the left or to turn around to the left. When the left turning operation unit 12A3 has received the input operation from the ship operator to cause the ship 11 to circle to the left or to turn around to the left, the communication unit 12B transmits to the ship 11 the input operation from the ship operator to cause the ship 11 to circle to the left or to turn around to the left, which is received by the left turning operation unit 12A3. The ship control device 11C of the ship 11 activates the actuator 11A to cause the ship 11 to circle to the left or to turn around to the left on the basis of the input operation from the ship operator to cause the ship 11 to circle to the left or to turn around to the left, which is received by the left turning operation unit 12A3.

The right turning operation unit 12A4 receives an input operation from the ship operator to cause the ship 11 to circle to the right or to turn around to the right. When the right turning operation unit 12A4 has received the input operation from the ship operator to cause the ship 11 to circle to the right or to turn around to the right, the communication unit 12B transmits to the ship 11 the input operation from the ship operator to cause the ship 11 to circle to the right or to turn around to the right, which is received by the right turning operation unit 12A4. The ship control device 11C of the ship 11 activates the actuator 11A to cause the ship 11 to circle to the right or to turn around to the right on the basis of the input operation from the ship operator to cause the ship 11 to circle to the right or to turn around to the right, which is received by the right turning operation unit 12A4.

The left moving operation unit 12A5 receives an input operation from the ship operator to move the ship 11 to the left (to move it laterally in a left direction). When the left moving operation unit 12A5 has received the input operation from the ship operator to move the ship 11 to the left, the communication unit 12B transmits to the ship 11 the input operation from the ship operator to move the ship 11 to the left, which is received by the left moving operation unit 12A5. The ship control device 11C of the ship 11 activates the actuator 11A to move the ship 11 to the left on the basis of the input operation from the ship operator to move the ship 11 to the left, which is received by the left moving operation unit 12A5.

The right moving operation unit 12A6 receives an input operation from the ship operator to move the ship 11 to the right (to move it laterally in a right direction). When the right moving operation unit 12A6 has received the input operation from the ship operator to move the ship 11 to the right, the communication unit 12B transmits to the ship 11 the input operation from the ship operator to move the ship 11 to the right, which is received by the right moving operation unit 12A6. The ship control device 11C of the ship 11 activates the actuator 11A to move the ship 11 to the right on the basis of the input operation from the ship operator to move the ship 11 to the right, which is received by the right moving operation unit 12A6.

The engine rotation speed switching operation unit 12A7 receives an input operation from the ship operator to switch a rotation speed of an engine 11A21 in, for example, three stages (a low speed, a medium speed, a high speed). When the engine rotation speed switching operation unit 12A7 has received the input operation from the ship operator to switch the rotation speed of the engine 11A21, the communication unit 12B transmits to the ship 11 the input operation from the ship operator to switch the rotation speed of the engine 11A21, which is received by the engine rotation speed switching operation unit 12A7. The ship control device 11C of the ship 11 switches the rotation speed of the engine 11A21 on the basis of the input operation from the ship operator to switch the rotation speed of the engine 11A21, which is received by the engine rotation speed switching operation unit 12A7.

That is, in the example shown in FIG. 1 and FIG. 2, the ship control device 11C includes a first operation mode in which a moment is generated in the ship 11 on the basis of the input operation received by the first operation unit 11B, and a second operation mode in which the actuator 11A is activated on the basis of the input operation received by the second operation unit 12A.

Because the ship 11 at sea is strongly affected by external disturbances such as wind and a tidal current, it is difficult for the ship operator to operate the ship 11 according to a complete manual operation when the ship control device 11C is in the second operation mode (that is, for example, when the ship 11 is operated by a ship operator located outside ship 11).

Therefore, in the example shown in FIG. 1 and FIG. 2, when the ship control device 11C is in the second operation mode, the ship control device 11C executes bow direction feedback control of the ship 11 on the basis of a deviation between a target bow direction and an actual bow direction of the ship 11. That is, when the ship control device 11C is in the second operation mode, the bow direction of the ship 11 is automatically controlled by the ship control device 11C without a need for the ship operator to control the bow direction of the ship 11 according to a manual operation.

For this reason, in the example shown in FIG. 1 and FIG. 2, the bow direction of the ship 11 can be appropriately controlled when the ship 11 is, for example, remotely operated. That is, the ship operator can concentrate on a moving forward operation of the ship 11, and the like, and can improve operability (for example, remote operability) of the ship 11.

Specifically, in the example shown in FIG. 1 and FIG. 2, even if the second operation unit 12A of the input device 12 does not receive an input operation from the ship operator when the ship control device 11C is in the second operation mode, the ship control device 11C executes bow direction holding control, which is feedback control of holding the actual bow direction of the ship 11 at the target bow direction on the basis of the deviation between the target bow direction and the actual bow direction of the ship 11. For this reason, when the ship control device 11C is in the second operation mode, the ship operator can direct the bow of the ship 11 in a desired direction by setting the target bow direction of the ship 11.

FIG. 3A TO FIG. 3D are diagrams for describing an example of control by the ship control device 11C when the right turning operation unit 12A4 of the second operation unit 12A of the input device 12 receives an input operation from a ship operator to cause the ship 11 to circle to the right or to turn around to the right.

Figures 3A, 3B, 3C, 3D:
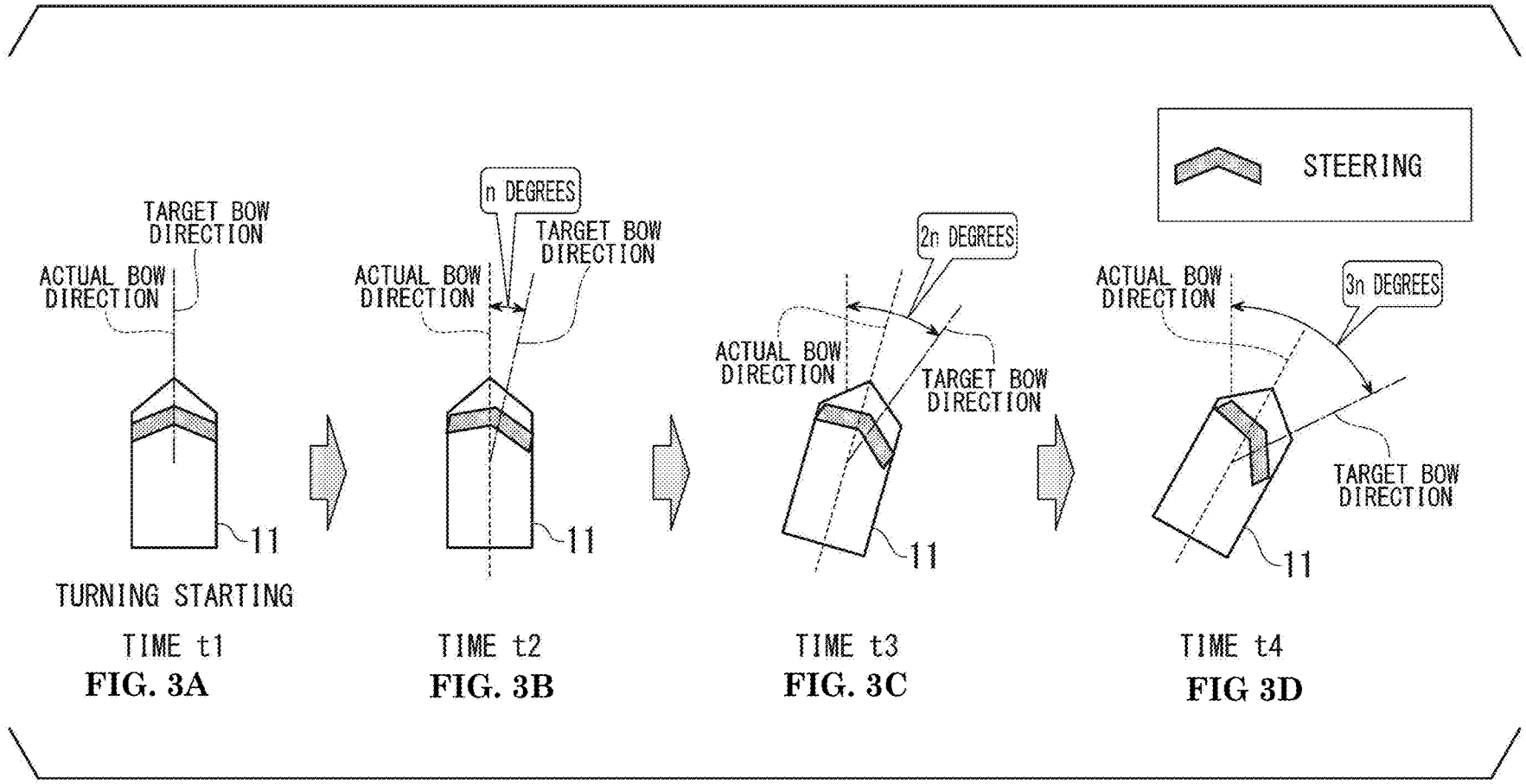
FIG. 3A to FIG. 3D are diagrams for describing an example of control by the ship control device when a right turning operation unit of the second operation unit of an input device has received an input operation from a ship operator to cause a ship to circle to the right or to turn around to the right.

FIG. 3A shows a state when the ship control device 11C is in the second operation mode and immediately before the right turning operation unit 12A4 receives the input operation from the ship operator to cause the ship 11 to circle to the right or to turn around to the right (at a time t1). At this stage, as shown in FIG. 3A, the actual bow direction and the target bow direction of the ship 11 approximately coincide with each other according to the bow direction holding control of the ship 11. In FIG. 3A to FIG. 3D, "steering" indicates a steering angle instruction value calculated by the ship control device 11C.

For example, at a time t2 when the ship control device 11C is in the second operation mode, if the right turning operation unit 12A4 receives an input operation from the ship operator to cause the ship 11 to circle to the right or to turn around to the right, as shown in FIG. 3B, the ship control device 11C changes the target bow direction of the ship 11 by a predetermined angle ("n degrees" in the example shown in FIG. 3A to FIG. 3D). That is, an angle formed between the target bow direction of the ship 11 at the time t1 and the target bow direction of the ship 11 at the time t2 is n degrees. Furthermore, the ship control device 11C executes the bow direction feedback control of the ship 11 on the basis of the deviation between the target bow direction which is changed by a predetermined angle (n degrees) and the actual bow direction. As a result, in the example shown in FIG. 3A to FIG. 3D, the ship 11 turns around to the right, and the actual bow direction of the ship 11 approaches the target bow direction shown in FIG. 3B.

In the example shown in FIG. 3A to FIG. 3D, at a time t3 after a predetermined period of time (for example, one control cycle of the ship control device 11C) has elapsed from the time t2, since the right turning operation unit 12A4 of the second operation unit 12A continues to receive the input operation from the ship operator to cause the ship 11 to circle to the right or to turn around to the right, the ship control device 11C adds an amount of change in the target bow direction of the ship 11 to the predetermined angle (n degrees) as shown in FIG. 3C. In other words, an angle formed between the target bow direction of the ship 11 at the time t1 and the target bow direction of the ship 11 at the time t3 is 2n degrees. Furthermore, the ship control device 11C executes the bow direction feedback control of the ship 11 on the basis of the deviation between the target bow direction of the amount of change added to the predetermined angle (n degrees) and the actual bow direction.

That is, in the ship control system 1 of the first embodiment, when the second operation unit 12A continues to receive the input operation from the ship operator to cause the ship 11 to circle to the right or to turn around to the right after a predetermined period of time (for example, one control cycle of the ship control device 11C) has elapsed from a time when the right turning operation unit 12A4 of the second operation unit 12A has received the input operation from the ship operator to cause the ship 11 to turn around to the right or to circle to the right, the ship control device 11C adds the amount of change in the target bow direction of the ship 11 to the predetermined angle (n degrees in the example shown in FIG. 3A to FIG. 3D).

In the example shown in FIG. 3A to FIG. 3D, at a time t4 after a predetermined period of time (for example, one control cycle of the ship control device 11C) has elapsed from the time t3, since the right turning operation unit 12A4 of the second operation unit 12A continues to receive the input operation from the ship operator to cause the ship 11 to turn around to the right or to circle to the right, the ship control device 11C further adds the amount of change in the target bow direction of the ship 11 to the predetermined angle (n degrees), as shown in FIG. 3D. In other words, an angle formed between the target bow direction of the ship 11 at the time t1 and the target bow direction of the ship 11 at the time t4 is 3n degrees. Furthermore, the ship control device 11C executes the bow direction feedback control of the ship 11 on the basis of the deviation between the target bow direction of the amount of change added to the predetermined angle (n degrees) and the actual bow direction.

For example, suppose that, when the right turning operation unit 12A4 of the second operation unit 12A has not received the input operation from the ship operator to cause the ship 11 to turn around to the right or to circle to the right at a time when the ship control device 11C is executing the bow direction feedback control of the ship 11 on the basis of the deviation between the target bow direction which is changed by a predetermined angle (n degrees) and the actual bow direction, specifically in a state shown in FIG. 3B (for example, immediately after the time t2), if the ship control device 11C executes the bow direction holding control of the ship 11 on the basis of the target bow direction shown in FIG. 3B, the ship operator may feel that the ship 11 will turn around to the right or circle to the right even though he does not intend to cause the ship 11 to turn around to the right or to circle to the right.

This is because the ship operator wants to determine the target bow direction of the ship 11 while watching a movement of the ship 11. In addition, since the actual bow direction of the ship 11 changes with a delay compared to the target bow direction, as described above, when the bow direction holding control of the ship 11 is executed on the basis of the target bow direction shown in FIG. 3B, the ship operator will have to decide a timing to stop the input operation that causes the ship 11 to turn around to the right or to circle to the right, taking into account a delay in changing the actual bow direction.

In view of the points described above, in the example shown in FIG. 3A to FIG. 3D, for example, when the right turning operation unit 12A4 of the second operation unit 12A has not received the input operation from the ship operator to cause the ship 11 to turn around to the right or to circle to the right at a time when the ship control device 11C is executing the bow direction feedback control of the ship 11 on the basis of the deviation between the target bow direction which is changed by a predetermined angle (n degrees) and the actual bow direction, specifically in the state shown in FIG. 3B (for example, immediately after the time t2), the ship control device 11C uses the actual bow direction (the actual bow direction shown in FIG. 3B) at a time when the right turning operation unit 12A4 of the second operation unit 12A has not received the input operation from the ship operator to cause the ship 11 to turn around to the right or to circle to the right (for example, immediately after the time t2) as the target bow direction, and executes the bow direction holding control of the ship 11.

Moreover, for example, when the right turning operation unit 12A4 of the second operation unit 12A has not received the input operation from the ship operator to cause the ship 11 to turn around to the right or to circle to the right at a time when the ship control device 11C is executing the bow direction feedback control of the ship 11 on the basis of the deviation between the target bow direction of the amount of change added to the predetermined angle (n degrees) and the actual bow direction, specifically, in a state shown in FIG. 3C (for example, immediately after the time t3), the ship control device 11C executes the bow direction holding control of the ship 11, using the actual bow direction (the actual bow direction shown in FIG. 3C) at a time when the right turning operation unit 12A4 of the second operation unit 12A has not received the input operation from the ship operator to cause the ship 11 to turn around to the right or to circle to the right (for example, immediately after the time t3) as the target bow direction.

In addition, for example, when the right turning operation unit 12A4 of the second operation unit 12A has not received the input operation from the ship operator to cause the ship 11 to turn around to the right or to circle to the right at a time when the ship control device 11C is executing the bow direction feedback control of the ship 11 on the basis of the deviation between the target bow direction of the amount of change added to a predetermined angle (n degrees) and the actual bow direction, specifically, in a state shown in FIG. 3D (for example, immediately after the time t4), the ship control device 11C executes the bow direction holding control of the ship 11, using the actual bow direction (the actual bow direction shown in FIG. 3D) at a time when the right turning operation unit 12A4 of the second operation unit 12A has not received the input operation from the ship operator to cause the ship 11 to turn around to the right or to circle to the right (for example, immediately after the time t4) as the target bow direction.

In the ship control system 1 of the first embodiment, when the left turning operation unit 12A3 of the second operation unit 12A has received the input operation from the ship operator to cause the ship 11 to turn around to the left or to circle to the left in the second operation mode of the ship 11 in the same manner as when the right turning operation unit 12A4 of the second operation unit 12A has received the input operation from the ship operator to cause the ship 11 to circle to the right or to turn around to the right, the ship control device 11C changes the target bow direction of the ship 11 by a predetermined angle (n degrees). Furthermore, the ship control device 11C executes the bow direction feedback control of the ship 11 on the basis of the deviation between the target bow direction which is changed by a predetermined angle (n degrees) and the actual bow direction.

When the left turning operation unit 12A3 of the second operation unit 12A continues to receive the input operation from the ship operator to cause the ship 11 to turn around to the left or to circle to the left after a predetermined period of time (for example, one control cycle of the ship control device 11C) has elapsed, the ship control device 11C adds the amount of change in the target bow direction of the ship 11 to the predetermined angle (n degrees). Furthermore, the ship control device 11C executes the bow direction feedback control of the ship 11 on the basis of the deviation between the target bow direction of the amount of change added to the predetermined angle (n degrees) and the actual bow direction.

In addition, in the ship control system 1 of the first embodiment, when the left turning operation unit 12A3 of the second operation unit 12A has not received the input operation from the ship operator to cause the ship 11 to turn around to the left or to circle to the left at a time when the ship control device 11C is executing the bow direction feedback control of the ship 11 on the basis of the deviation between target bow direction which is changed by a predetermined angle (n degrees) and the actual bow direction in the same manner as when the right turning operation unit 12A4 of the second operation unit 12A has not received the input operation from the ship operator to cause the ship 11 to circle to the right or to turn around to the right, the ship control device 11C executes the bow direction feedback control of the ship 11, using the actual bow direction at a time when the left turning operation unit 12A3 of the second operation unit 12A has not received the input operation from the ship operator to cause the ship 11 to turn around to the left or to circle to the left as the target bow direction.

In addition, in the ship control system 1 of the first embodiment, when the left turning operation unit 12A3 of the second operation unit 12A has not received the input operation from the ship operator to cause the ship 11 to turn around to the left or to circle to the left at a time when the ship control device 11C is executing the bow direction feedback control of the ship 11 on the basis of the deviation between target bow direction of the amount of change added to the predetermined angle (n degrees) and the actual bow direction in the same manner as when the right turning operation unit 12A4 of the second operation unit 12A has not received the input operation from the ship operator to cause the ship 11 to circle to the right or to turn around to the right, the ship control device 11C executes the bow direction feedback control of the ship 11, using the actual bow direction at a time when the left turning operation unit 12A3 of the second operation unit 12A has not received the input operation from the ship operator to cause the ship 11 to turn around to the left or to circle to the left as the target bow direction.

Figures 4A, 4B, 4C:
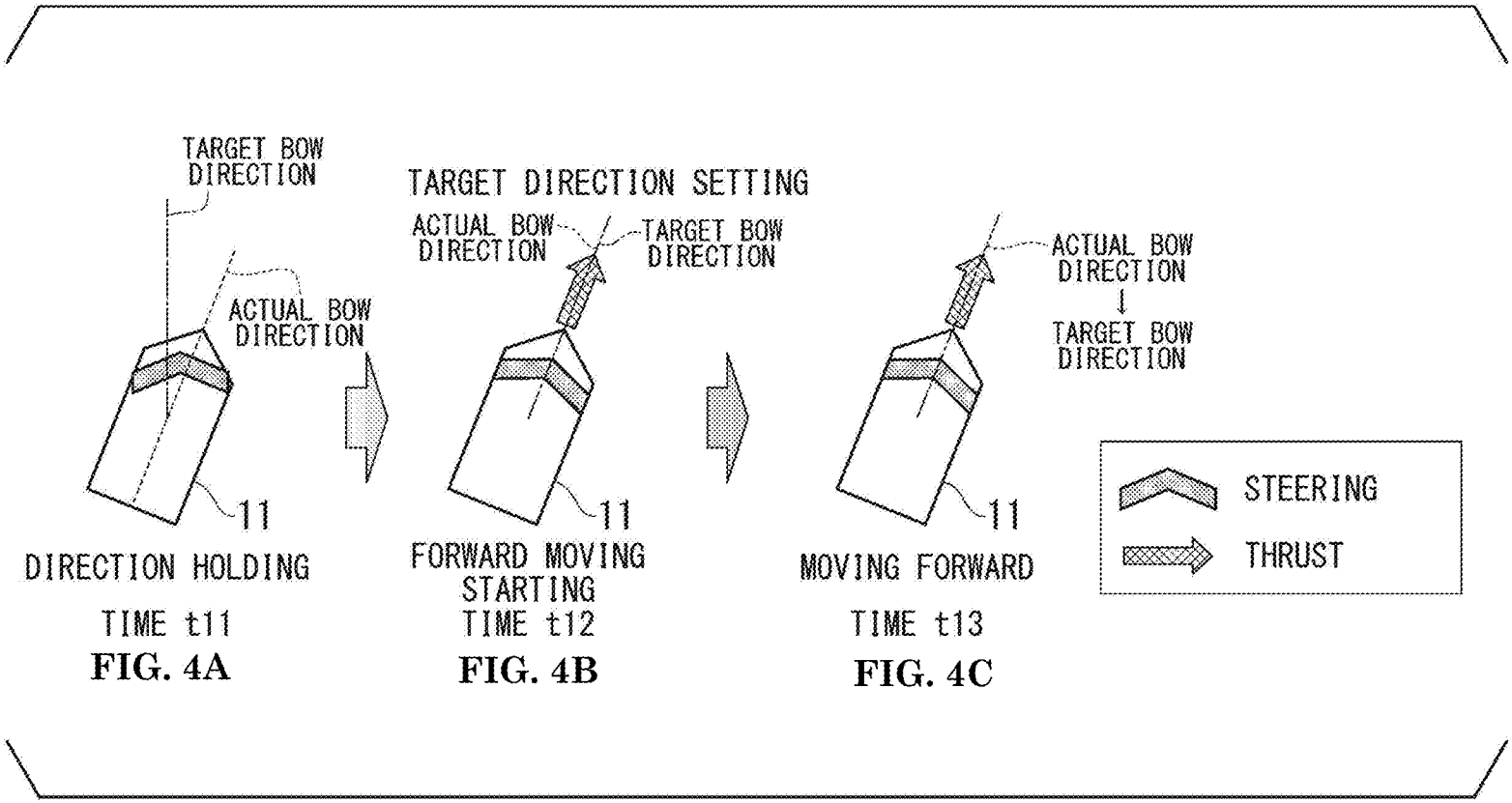
FIG. 4A to FIG. 4C are diagrams for describing an example of the control by the ship control device when a forward traveling operation unit of the second operation unit of the input device has received an input operation from the ship operator to move the ship forward.

FIG. 4A to FIG. 4C are diagrams for describing an example of the control by the ship control device 11C when the forward traveling operation unit 12A1 of the second operation unit 12A of the input device 12 has received the input operation from the ship operator to move the ship 11 forward.

FIG. 4A shows a state when the ship control device 11C is in the second operation mode, and the ship control device 11C is executing the bow direction holding control of the ship 11 (a time t11) without the second operation unit 12A of the input device 12 receiving the input operation from the ship operator. That is, in the state shown in FIG. 4A, the ship control device 11C is trying to match the actual bow direction of the ship 11 with the target bow direction.

Next, as shown in FIG. 4B, at a time t12, if the forward traveling operation unit 12A1 of the second operation unit 12A receives the input operation from the ship operator to move the ship 11 forward, the ship control device 11C executes the bow direction feedback control of the ship 11 and starts control of moving the ship 11 forward (that is, the thrust generation unit 11A2 of the actuator 11A generates the thrust shown in FIG. 4A to FIG. 4C), using the actual bow direction at a time when the forward traveling operation unit 12A1 of the second operation unit 12A has received the input operation from the ship operator to move the ship 11 forward (a time t12, that is, a time when moving forward is started) (the actual bow direction shown in FIG. 4A) as the target bow direction.

Since the ship 11 at sea is strongly affected by external disturbances such as wind and a tidal current, when the ship control device 11C is in the second operation mode, and the ship control device 11C is executing the bow direction holding control of the ship 11 (the time t11) without the second operation unit 12A of the input device 12 receiving the input operation from the ship operator, the bow direction (actual bow direction) of the ship 11 constantly changes. Generally, the ship operator starts an operation of moving the ship 11 forward at a timing when the bow of the ship 11 is facing a direction intended by the ship operator.

Therefore, in the ship control system 1 of the first embodiment, as described above, the ship control device 11C executes the bow direction feedback control of the ship 11 and starts the control of moving the ship 11 forward, using the actual bow direction at the time when the forward traveling operation unit 12A1 of the second operation unit 12A has received the input operation from the ship operator to move the ship 11 forward as the target bow direction.

For this reason, in the ship control system 1 of the first embodiment, it is possible to improve a second operability of the ship 11 by the ship operator.

In the example shown in FIG. 4A to FIG. 4C, next, if the forward traveling operation unit 12A1 of the second operation unit 12A does not receive the input operation from the ship operator to move the ship 11 forward at a time t13 when the ship control device 11C is executing the control of moving the ship 11 forward, the ship control device 11C ends the control for moving the ship 11 forward, and the thrust generation unit 11A2 of the actuator 11A does not generate the thrust shown in FIG. 4A to FIG. 4C. Furthermore, the ship control device 11C executes the bow direction holding control of the ship 11, using the actual bow direction at a time when the forward traveling operation unit 12A1 of the second operation unit 12A has not received the input operation from the ship operator to move the ship 11 forward (a time t13) (the actual bow direction shown in FIG. 4C) as the target bow direction.

In an example of the ship control system 1 of the first embodiment, when the backward traveling operation unit 12A2 of the second operation unit 12A has received the input operation from the ship operator to move the ship 11 backward when the ship control device 11C is in the second operation mode in the same manner as in the example shown in FIG. 4A to FIG. 4C, the ship control device 11C executes the bow direction feedback control of the ship 11 and executes control of moving the ship 11 backward, using the actual bow direction at a time when the backward traveling operation unit 12A2 of the second operation unit 12A has received the input operation from the ship operator to move the ship 11 backward (that is, a time when moving backward is started) as the target bow direction.

In addition, in an example of the ship control system 1 of the first embodiment, when the second backward traveling operation unit 12A2 of the second operation unit 12A has not received the input operation from the ship operator to move the ship 11 backward in the same manner as in the example shown in FIG. 4A to FIG. 4C, the ship control device 11C executes the bow direction feedback control of the ship 11, using the actual bow direction at a time when the backward traveling operation unit 12A2 of the second operation unit 12A has not received the input operation from the ship operator to move the ship 11 backward as the target bow direction.

As described above, in the example shown in FIG. 4A to FIG. 4C, during the bow direction holding control of the ship 11, the ship control device 11C executes the bow direction feedback control of the ship 11 and starts the control of moving the ship 11 forward, using the actual bow direction at the time when the forward traveling operation unit 12A1 of the second operation unit 12A has received the input operation from the ship operator to move the ship 11 forward as the target bow direction. In another example, during the bow direction holding control of the ship 11, the ship control device 11C may also set the target bow direction at the time when the forward traveling operation unit 12A1 of the second operation unit 12A has received the input operation from the ship operator to move the ship 11 forward as the target bow direction of control of moving the ship 11 forward and the bow direction feedback control of the ship 11.

Moreover, in the example of the ship control system 1 of the first embodiment described above, during the bow direction holding control of the ship 11, the ship control device 11C executes the bow direction feedback control of the ship 11 and starts the control of moving the ship 11 backward, using the actual bow direction at the time when the backward traveling operation unit 12A2 of the second operation unit 12A has received the input operation from the ship operator to move the ship 11 backward as the target bow direction. In another example, during the bow direction holding control of the ship 11, the ship control device 11C may also set the target bow direction at the time when the backward traveling operation unit 12A2 of the second operation unit 12A has received the input operation from the ship operator to move the ship 11 backward as the target bow direction of the control of moving the ship 11 backward and the bow direction feedback control of the ship 11.

FIG. 5A to FIG. 5F are diagrams for describing an example of the control by the ship control device 11C when the right moving operation unit 12A6 of the second operation unit 12A of the input device 12 has received the input operation from the ship operator to move the ship 11 to the right (to move it laterally in the right direction).

As shown in FIG. 5A, if the right moving operation unit 12A6 of the second operation unit 12A receives the input operation from the ship operator to move the ship 11 laterally in the right direction when the ship control device 11C is in the second operation mode and the ship control device 11C is executing the bow direction holding control of the ship 11 (at a time t21), the ship control device 11C sets a bow direction obtained by rotating the actual bow direction or the target bow direction at the time (that is, the time t21) when the right moving operation unit 12A6 of the second operation unit 12A has received the input operation from the ship operator to move the ship 11 laterally in the right direction (the right direction of FIG. 5A to FIG. 5F) to the left direction by a predetermined angle (for example, 90 degrees) as the target bow direction, and executes the bow direction feedback control of the ship 11. As a result, the bow direction of the ship 11 rotates counterclockwise, as shown in FIG. 5B and FIG. 5C.

Furthermore, as shown in FIGS. 5B and 5C, the ship control device 11C executes the control of moving the ship 11 backward. As a result, thrust as shown in FIG. 5B and FIG. 5C is generated.

Next, as shown in FIG. 5D, at an end of the lateral movement of the ship 11 in the right direction (a time t22), the ship control device 11C sets the actual bow direction (that is, the actual bow direction shown in FIG. 5A) or the target bow direction at the time when the right moving operation unit 12A6 of the second operation unit 12A has received the input operation from the ship operator to move the ship 11 laterally in the right direction (the time t21) as the target bow direction, and executes the bow direction feedback control of the ship 11. As a result, the bow direction of the ship 11 rotates clockwise as shown in FIG. 5E and FIG. 5F.

Alternatively, if the right moving operation unit 12A6 of the second operation unit 12A has received the input operation from the ship operator to move the ship 11 laterally in the right direction when the ship control device 11C is in the second operation mode, the ship control device 11C may set the bow direction obtained by rotating the actual bow direction or the target bow direction at the time when the right moving operation unit 12A6 of the second operation unit 12A has received the input operation from the ship operator to move the ship 11 laterally in the right direction to the right direction by a predetermined angle (for example, 90 degrees) as the target bow direction, execute the bow direction feedback control of the ship 11, and execute the control of moving the ship 11 forward. At an end of the lateral movement of the ship 11 in the right direction, the ship control device 11C may set the actual bow direction or the target bow direction at the time when the right moving operation unit 12A6 of the second operation unit 12A has received the input operation from the ship operator to move the ship 11 laterally in the right direction as the target bow direction, and execute the bow direction feedback control of the ship 11.

In the ship control system 1 of the first embodiment, if the left moving operation unit 12A5 of the second operation unit 12A receives the input operation from the ship operator to move the ship 11 laterally in the left direction in the second operation mode of the ship 11 in the same manner as when the right moving operation unit 12A6 of the second operation unit 12A has received the input operation from the ship operator to move the ship 11 laterally in the right direction, the ship control device 11C executes the bow direction feedback control of the ship 11 and executes the control of moving the ship 11 backward, using the bow direction obtained by rotating the actual bow direction or the target bow direction at the time when the left moving operation unit 12A5 of the second operation unit 12A has received the input operation from the ship operator to move the ship 11 laterally in the left direction to the right direction by a predetermined angle (for example, 90 degrees) as the target bow direction.

Next, at the end of the lateral movement of the ship 11 in the left direction, the ship control device 11C executes the bow direction feedback control of the ship 11, using the actual bow direction or the target bow direction at the time when the left moving operation unit 12A5 of the second operation unit 12A has received the input operation from the ship operator to move the ship 11 laterally in the left direction as the target bow direction.

Alternatively, when the left moving operation unit 12A5 of the second operation unit 12A has received the input operation from the ship operator to move the ship 11 laterally in the left direction when the ship control device 11C is in the second operation mode, the ship control device 11C may execute the bow direction feedback control of the ship 11 and execute the control of moving the ship 11 forward, using the bow direction obtained by rotating the actual bow direction or the target bow direction at the time when the left moving operation unit 12A5 of the second operation unit 12A has received the input operation from the ship operator to move the ship 11 laterally in the left direction to the left direction by a predetermined angle (for example, 90 degrees) as the target bow direction. At the end of the lateral movement of the ship 11 in the left direction, the ship control device 11C may execute the bow direction feedback control of the ship 11, using the actual bow direction or the target bow direction at the time when the left moving operation unit 12A5 of the second operation unit 12A has received the input operation from the ship operator to move the ship 11 laterally in the left direction as the target bow direction.

As described above, in the ship control system 1 of the first embodiment, by appropriately incorporating the bow direction holding control of the ship 11, safe and smooth remote operation of the ship 11 by, for example, the ship operator positioned outside the ship 11 can be realized.

Figure 6:
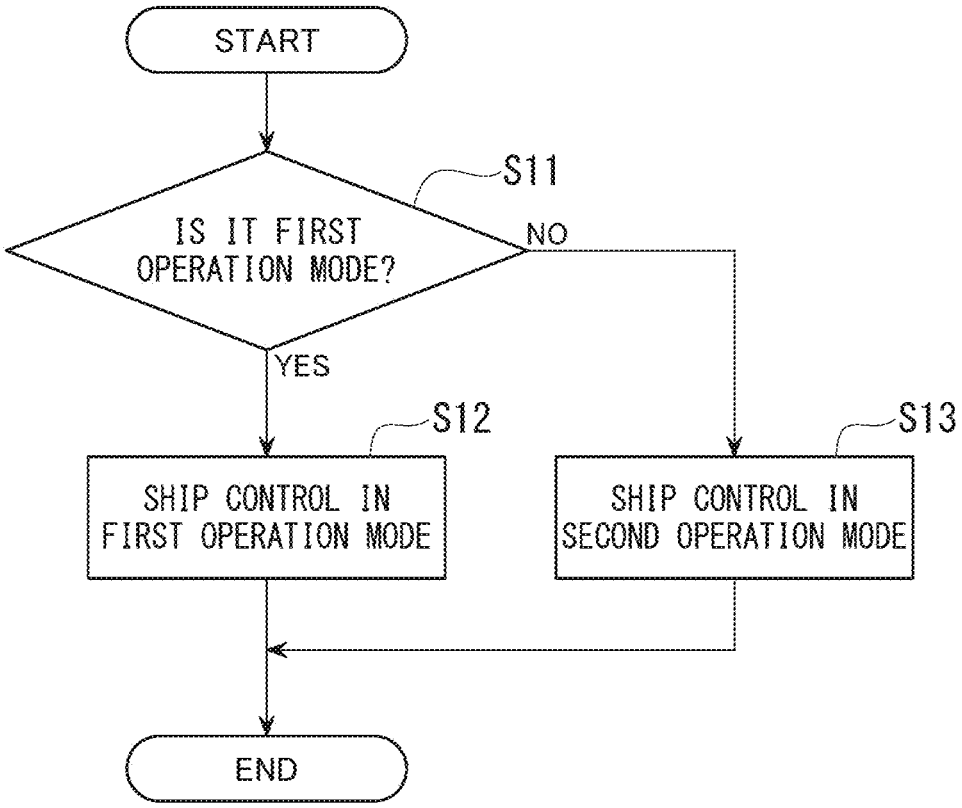
FIG. 6 is a flowchart for describing an example of processing executed by the ship control device of the first embodiment.

FIG. 6 is a flowchart for describing an example of processing executed by the ship control device 11C of the first embodiment.

In the example shown in FIG. 6, the ship control device 11C determines whether a mode of the ship control device 11C is the first operation mode (a mode in which a moment is generated in the ship 11 on the basis of the input operation received by the first operation unit 11B) or the second operation mode (a mode in which the actuator 11A is activated on the basis of the input operation received by the second operation unit 12A) in step S11. When the mode of the ship control device 11C is the first operation mode, the processing proceeds to step S12. On the other hand, when the mode of the ship control device 11C is the second operation mode, the processing proceeds to step S13.

In step S12, the ship control device 11C executes ship control in the first operation mode. Specifically, a moment is generated in the ship 11 on the basis of the input operation received by the first operation unit 11B.

In step S13, the ship control device 11C executes ship control in the second operation mode. Specifically, the actuator 11A is activated on the basis of the input operation received by the second operation unit 12A of the input device 12. Specifically, the ship control device 11C executes the bow direction feedback control of the ship 11 on the basis of the deviation between the target bow direction and the actual bow direction of the ship 11.

Second Embodiment

Hereinafter, a second embodiment of the ship control system, the ship control device, the ship control method, and the non-transitory computer readable medium of the present invention will be described.

The ship control system 1 of the second embodiment is configured similarly to the ship control system 1 of the first embodiment described above, except for points to be described below. Therefore, according to the ship control system 1 of the second embodiment, it is possible to achieve the same effects as the ship control system 1 of the first embodiment described above, except for the points to be described below.

FIG. 7A to FIG. 7D is a diagram for describing an example of the control by the ship control device 11C when the right turning operation unit 12A4 of the second operation unit 12A of the input device 12 of the ship control system 1 according to the second embodiment has received the input operation from the ship operator to cause the ship 11 to circle to the right or to turn around to the right.

FIG. 7A shows a state in which the ship control device 11C in the second operation mode, and the ship 11 is turning around to the right as a result of the right turning operation unit 12A4 receiving the input operation from the ship operator to cause the ship 11 to circle to the right or to turn around to the right. In detail, FIG. 7A shows a state immediately before the right turning operation unit 12A4 does not receive the input operation from the ship operator to cause the ship 11 to circle to the right or to turn around to the right (a time t31).

In the ship control system 1 of the second embodiment, when the right turning operation unit 12A4 of the second operation unit 12A has received the input operation from the ship operator to cause the ship 11 to turn around to the right or to circle to the right when the ship control device 11C is in the second operation mode, in the same manner as in the ship control system 1 of the first embodiment (the example shown in FIG. 4A to FIG. 4C), the ship control device 11C changes the target bow direction of the ship 11 by a predetermined angle (n degrees) and executes the bow direction feedback control of the ship 11 on the basis of the deviation between the target bow direction which is changed by the predetermined angle (n degrees) and the actual bow direction.

In the example shown in FIG. 7A to FIG. 7D, then, as shown in FIG. 7B, the right turning operation unit 12A4 does not receive the input operation from the ship operator to cause the ship 11 to circle to the right or to turn around to the right at a time t32. The ship control device 11C sets the actual bow direction at the time when the right turning operation unit 12A4 of the second operation unit 12A has not received the input operation from the ship operator to cause the ship 11 to circle to the right or to turn around to the right (a time t32) as the target bow direction.

On the other hand, even after the time t32 when the right turning operation unit 12A4 of the second operation unit 12A has not received the input operation from the ship operator to cause the ship 11 to circle to the right or to turn around to the right, as shown in FIG. 7C, the ship 11 tries to continue turning around to the right due to inertial force while turning around to the right. For this reason, in the example shown in FIG. 7A to FIG. 7D, the ship control device 11C activates the actuator 11A to prevent the ship 11 from continuing turning around to the right due to the inertial force. Specifically, at a time t33 after the time t32, the ship control device 11C generates a moment for causing the ship 11 to turn around to the left or to circle to the left in the ship 11, using the actual bow direction at the time (time t32) when the right turning operation unit 12A4 of the second operation unit 12A has not received the input operation from the ship operator to cause the ship 11 to circle to the right or to turn around to the right as the target bow direction.

As a result, as shown in FIG. 7D, at time t34, an angular speed of the right turning of the ship 11 becomes equal to or less than a threshold value due to the moment for causing the ship 11 to turn around to the left or to circle to the left. The ship control device 11C executes the bow direction holding control of the ship 11, using the actual bow direction of the ship 11 at the time when the angular speed of the right turning of the ship 11 becomes equal to or less than the threshold value (a time t34) as the target bow direction.

In another example, as shown in FIG. 7B, when the right turning operation unit 12A4 has not received the input operation from the ship operator to cause the ship 11 to circle to the right or to turn around to the right at the time t32, the ship control device 11C may set the actual bow direction at the time (the time t32) when the right turning operation unit 12A4 of the second operation unit 12A has not received the input operation from the ship operator to cause the ship 11 to circle to the right or to turn around to the right as the target bow direction.

In this example, as shown in FIG. 7B, when the right turning operation unit 12A4 has not received the input operation from the ship operator to cause the ship 11 to circle to the right or to turn around to the right at the time t32, the ship control device 11C generates the moment for causing the ship 11 to turn around to the left or to circle to the left in the ship 11, using a method other than the method of setting the actual bow direction at the time (the time t32) when the right turning operation unit 12A4 of the second operation unit 12A has not received the input operation from the ship operator to cause the ship 11 to circle to the right or to turn around to the right as the target bow direction.

In still another example, as shown in FIG. 7B, when the right turning operation unit 12A4 has not received the input operation from the ship operator to cause the ship 11 to circle to the right or to turn around to the right at the time t32, the ship control device 11C does not have to generate the moment for causing the ship 11 to turn around to the left or to circle to the left in the ship 11.

In this example, as shown in FIG. 7B, when the right turning operation unit 12A4 has not received the input operation from the ship operator to cause the ship 11 to circle to the right or to turn around to the right at the time t32, the ship control device 11C does not generate a moment for causing the ship 11 to turn around to the right or to circle to the right in the ship 11, so that the angular speed of the right turning of the ship 11 decreases to a threshold value or less due to water resistance or the like.

In a first example of the ship control system 1 of the second embodiment, when the ship control device 11C is in the second operation mode and the right turning operation unit 12A4 of the second operation unit 12A has not received the input operation from the ship operator to cause the ship 11 to turn around to the right or to circle to the right at a time when the ship 11 is turning around to the right, the ship control device 11C generates the moment for causing the ship 11 to turn around to the left or to circle to the left in the ship 11, using the actual bow direction at the time when the right turning operation unit 12A4 of the second operation unit 12A has not received the input operation from the ship operator to cause the ship 11 to turn around to the right or to circle to the right as the target bow direction. Next, the ship control device 11C executes the bow direction holding control of the ship 11, using the actual bow direction at the time when the angular speed of the right turning of the ship 11 becomes equal to or less than the threshold value due to the moment for causing the ship 11 to turn around to the left or to circle to the left as the target bow direction.

In a second example of the ship control system 1 of the second embodiment, when the ship control device 11C is in the second operation mode and the right turning operation unit 12A4 of the second operation unit 12A has not received the input operation from the ship operator to cause the ship 11 to turn around to the right or to circle to the right at the time when the ship 11 is turning around to the right, the ship control device 11C generates the moment for causing the ship 11 to turn around to the left or to circle to the left in the ship 11, using the actual bow direction at the time when the right turning operation unit 12A4 of the second operation unit 12A has not received the input operation from the ship operator to cause the ship 11 to turn around to the right or to circle to the right as the target bow direction. Next, the ship control device 11C executes the bow direction feedback control of the ship 11 and causes the thrust generation unit 11A2 to generate thrust for moving the ship 11 forward or backward, using the actual bow direction at the time when the angular speed of the right turning of the ship 11 becomes equal to or less than the threshold value due to the moment for causing the ship 11 to turn around to the left or to circle to the left as the target bow direction.

In a third example of the ship control system 1 of the second embodiment, when the ship control device 11C is in the second operation mode and the left turning operation unit 12A3 of the second operation unit 12A has not received the input operation from the ship operator to cause the ship 11 to turn around to the left or to circle to the left at a time when the ship 11 is turning around to the left, the ship control device 11C generates the moment for causing the ship 11 to turn around to the right or to circle to the right in the ship 11, using the actual bow direction at the time when the left turning operation unit 12A3 of the second operation unit 12A has not received the input operation from the ship operator to cause the ship 11 to turn around to the left or to circle to the left as the target bow direction. Next, the ship control device 11C executes the bow direction holding control of the ship 11, using the actual bow direction at the time when the angular speed of the left turning of the ship 11 becomes equal to or less than the threshold value due to the moment for causing the ship 11 to turn around to the right or to circle to the right as the target bow direction.

In a fourth example of the ship control system 1 of the second embodiment, when the ship control device 11C is in the second operation mode and the left turning operation unit 12A3 of the second operation unit 12A has not received the input operation from the ship operator to cause the ship 11 to turn around to the left or to circle to the left at the time when the ship 11 is turning around to the left, the ship control device 11C generates the moment for causing the ship 11 to turn around to the right or to circle to the right in the ship 11, using the actual bow direction at the time when the left turning operation unit 12A3 of the second operation unit 12A has not received the input operation from the ship operator to cause the ship 11 to turn around to the left or to circle to the left as the target bow direction. Next, the ship control device 11C executes the bow direction feedback control of the ship 11 and causes the thrust generation unit 11A2 to generate thrust for moving the ship 11 forward or backward, using the actual bow direction at the time when the angular speed of the left turning of the ship 11 becomes equal to or less than the threshold value due to the moment for causing the ship 11 to turn around to the right or to circle to the right as the target bow direction.

Third Embodiment

A third embodiment of the ship control system, the ship control device, the ship control method, and the non-transitory computer readable medium of the present invention will be described below.

A ship control system 1 of the third embodiment is configured similarly to the ship control system 1 of the first embodiment described above, except for points described below. Therefore, according to the ship control system 1 of the third embodiment, it is possible to achieve the same effects as the ship control system 1 of the first embodiment described above, except for the points described below.

As described above, the ship 11 of the first embodiment is, for example, a PWC that has the same functions as the PWC described in FIG. 1 of Japanese Patent No. 5196649.

On the other hand, the ship 11 of the third embodiment is, for example, a jet propulsion boat that has the same functions as a jet propulsion boat called a jet boat or a sports boat described in FIG. 1 of Japanese Unexamined Patent Application, First Publication No. 2020-019321.

Fourth Embodiment

Hereinafter, a fourth embodiment of the ship control system, the ship control device, the ship control method, and the non-transitory computer readable medium of the present invention will be described.

A ship control system 1 of the fourth embodiment is configured similarly to the ship control system 1 of the first embodiment described above, except for points described below. Therefore, according to the ship control system 1 of the fourth embodiment, it is possible to achieve the same effects as the ship control system 1 of the first embodiment described above, except for the points described below.

A ship 11 of the fourth embodiment is a ship that is not equipped with a jet propulsion machine (for example, a ship equipped with an outboard motor, a ship equipped with inboard and outboard motors or an inboard engine, a large ship equipped with side thrusters, or the like described in Japanese Patent No. 6198192, Japanese Unexamined Patent Application, First Publication No. 2007-22284, and the like).

Although a mode for implementing the present invention has been described above using embodiments, the present invention is not limited to these embodiments in any way, and various modifications and substitutions can be added within a range not departing from the gist of the present invention. The configurations described in each of the embodiments and examples described above may be combined.

Note that all or part of functions of each part of the ship control system 1 in the embodiment described above may be achieved by recording a program for realizing these functions on a computer-readable recording medium and causing a computer system to read and execute the program recorded in this recording medium. Note that a term "computer system" herein includes an OS and hardware such as peripheral devices.

Furthermore, a term "computer-readable recording medium" refers to a portable medium such as a flexible disk, a magneto-optical disk, a ROM, or a CD-ROM, or a storage unit such as a hard disk embedded in a computer system. Furthermore, the "computer-readable recording medium" may include a unit that dynamically stores a program for a short period of time, such as a communication line when a program is transmitted via a network such as the Internet or a communication line such as a telephone line, and a unit that retains the program for a certain period of time, such as a volatile memory inside the computer system serving as a server or a client in this case. Moreover, the program described above may be a program for realizing a part of the functions described above or may be a program that can realize the functions described above in combination with a program already recorded in the computer system.

REFERENCE SIGNS LIST

1 Ship control system
11 Ship
11A Actuator
11A1 Rudder unit
11A2 Thrust generation unit
11A21 Engine
11B First operation unit
11B1 Steering unit
11B2 Throttle operation unit
11B3 Target bow direction setting unit
11C Ship control device
11D Bow direction detection unit
11E Communication unit
12 Input device
12A Second operation unit
12A1 Forward traveling operation unit
12A2 Backward traveling operation unit

12A3 Left turning operation unit
12A4 Right turning operation unit
12A5 Left moving operation unit
12A6 Right moving operation unit
12A7 Engine rotation speed switching operation unit
12B Communication unit

The invention claimed is:

1. A ship control system that includes a ship and an input device, wherein the ship includes:

an actuator having a function of generating thrust for the ship and a function of generating a moment in the ship;

a first operation unit configured to receive an input operation from a ship operator;

a ship control device configured to activate the actuator; and a bow direction detection unit configured to detect an actual bow direction of the ship, the input device is a communication device separate from the ship, is carried by the ship operator, and is capable of receiving an input operation from the ship operator from outside the ship, the input device including operation units for forward traveling, backward traveling, lateral moving, or turn/circle moving of the ship, and a communication unit configured to transmit the input operations to the ship; and the ship control device includes a first operation mode and a second operation mode, a moment is generated in the ship on the basis of the input operation received by the first operation unit in the first operation mode, the actuator is activated on the basis of the input operation received by the input device in the second operation mode, the ship control device executes bow direction feedback control of the ship on the basis of a deviation between a target bow direction and an actual bow direction of the ship in the second operation mode, and in the second operation mode, the ship control device is configured to in response to the input device starting to receive the input operation to move or turn/circle the ship to a target direction, automatically capture and set an actual bow direction detected by the bow direction detection unit at the time when the input operation is started as the target bow direction; and execute bow direction feedback control of the ship on the basis of a deviation between the target bow direction and the actual bow direction to automatically maintain the captured target bow direction without an instruction of the bow direction to the input device by the ship operator while the input operation to move the ship is being received.

2. The ship control system according to claim 1, wherein, even if the input device does not receive an input operation from the ship operator in the second operation mode, the ship control device executes bow direction holding control that is feedback control of holding an actual bow direction of the ship in a target bow direction on the basis of the deviation between the target bow direction and the actual bow direction of the ship.

3. The ship control system according to claim 1, wherein when the input device has received an input operation from the ship operator to cause the ship to turn around or to circle in the second operation mode, the ship control device changes the target bow direction of the ship, which had been received by the input operation from the ship operator before the input device had been received the input operation to turn around or circle, by a predetermined angle, and executes the bow direction feedback control of the ship on the basis of a deviation between the target bow direction that is changed by the predetermined angle and the actual bow direction at the time the input operation has received, and in a state in which the input device continues to receive the input operation from the ship operator to cause the ship to turn around or to circle after a predetermined period of time has elapsed, the ship control device adds an amount of change in the target bow direction of the ship to the predetermined angle, and executes the bow direction feedback control of the ship on the basis of a deviation between the target bow direction of the amount of change added to the predetermined angle and the actual bow direction at the time the predetermined period of time has elapsed.

4. The ship control system according to claim 3, wherein, when the input device has not received the input operation from the ship operator to cause the ship to turn around or to circle at a time when the ship control device executes the bow direction feedback control of the ship on the basis of the deviation between the target bow direction that is changed by the predetermined angle and the actual bow direction or at a time when the ship control device executes the bow direction feedback control of the ship on the basis of a deviation between the target bow direction of the amount of change added to the predetermined angle and the actual bow direction, the ship control device executes the bow direction holding control of the ship, using the actual bow direction at a time when the input device has not received the input operation from the ship operator to cause the ship to turn around or to circle as the target bow direction.

5. The ship control system according to claim 1, wherein, in a state in which the input device has received an input operation from the ship operator to move the ship in one of left and right directions in the second operation mode, the ship control device rotates the ship in a first rotation direction without an instruction of the rotation to the input device by the ship operator while executing the bow direction feedback control of the ship, using a bow direction obtained by rotating the actual bow direction or the target bow direction at the time when the input device has received the input operation from the ship operator to move the ship laterally in the one of the left and right directions to the other of the left and right directions by a predetermined angle as the target bow direction, and while the input device continues to receive the input operation for lateral movement, the ship control device continues to move the ship backward without an instruction for movement backward to the input device; and then when the input device stops receiving the input operation for the lateral movement, the ship control device rotates the ship in a second rotation direction opposite to the first rotation direction without an instruction of the rotation to the input device by the ship operator while executing the bow direction feedback control of the ship, using the actual bow direction or the target bow direction at the time when the input device has received the input operation from the ship operator to move the ship laterally in the one direction at an end of the lateral movement of the ship in the one direction as the target bow direction after the end of the lateral movement of the ship in the one direction.

6. The ship control system according to claim 1, wherein, in a state in which the input device has received the input operation from the ship operator to move the ship in one of the left and right directions in the second operation mode, the ship control device rotates the ship in a first rotation direction without an instruction of the rotation to the input device by the ship operator while executing the bow direction feedback control of the ship and executes control of moving the ship forward, using a bow direction obtained by rotating the actual bow direction or the target bow direction at the time when the input device has received the input operation from the ship operator to move the ship laterally in the one of the left and right directions to the other of the left and right directions by a predetermined angle as the target bow direction, while the input device continues to receive the input operation for the lateral movement, the ship control device continues to move the ship forward without an instruction for movement forward to the input device; and then when the input device stops receiving the input operation for the lateral movement, the ship control device rotates the ship in a second rotation direction opposite to the first rotation direction without an instruction of the rotation to the input device by the ship operator while executing the bow direction feedback control of the ship, using the actual bow direction or the target bow direction at the time when the input device has received the input operation from the ship operator to move the ship laterally in the one direction at an end of the lateral movement of the ship in the one direction as the target bow direction after the end of the lateral movement of the ship in the one direction.

7. The ship control system according to claim 1, wherein the ship control device changes the target bow direction of the ship by a predetermined angle, and executes the bow direction feedback control of the ship on the basis of the deviation between the target bow direction that is changed by the predetermined angle and the actual bow direction when the input device has received the input operation from the ship operator to cause the ship to turn around or to circle in one of clockwise and counterclockwise directions in the second operation mode, and when an angular speed of the turning or circling of the ship in the one of the clockwise and counterclockwise directions becomes equal to or less than a threshold value after the input device has not received the input operation from the ship operator to cause the ship to turn around or circle in the one of the clockwise and counterclockwise directions, the ship control device executes the bow direction holding control of the ship, using the actual bow direction at a time when the angular speed of the turning or circling of the ship in one of the clockwise and counterclockwise directions becomes equal to or less than the threshold value as the target bow direction.

8. The ship control system according to claim 7, wherein, when the input device has not received the input operation from the ship operator to cause the ship to turn around or to circle in one of the clockwise and counterclockwise directions, the ship control device generates a moment for causing the ship to turn around or to circle in the other of the clockwise or counterclockwise directions in the ship, and thereby the angular speed of the turning or circling of the ship in the one of the clockwise or counterclockwise directions becomes equal to or less than a threshold value.

9. The ship control system according to claim 7, wherein, when the input device has not received the input operation from the ship operator to cause the ship to turn around or to circle in one of the clockwise and counterclockwise directions, the ship control device generates a moment for causing the ship to turn around or to circle in the other of the clockwise or counterclockwise directions in the ship, using the actual bow direction at the time when the input device has not received the input operation from the ship operator to cause the ship to turn around or to circle in one of the clockwise and counterclockwise directions as the target bow direction.

10. The ship control system according to claim 1, wherein, in the second operation mode, when the input device is receiving an input operation from the ship operator to move the ship forward or backward, the ship control device causes the ship to move forward or backward in the direction received by the input device without changing the input operation to the input device, by executing bow direction feedback control of the ship on the basis of a deviation between the target bow direction and the detected actual bow direction, even if a disturbance occurs.

11. The ship control system according to claim 10, wherein, in the second operation mode, when the input device has received an input operation from the ship operator to move the ship forward or backward, the ship control device, after setting the actual bow direction at the time the input device received the input operation from the ship operator to move the ship forward or backward as the target bow direction, executes the bow direction feedback control of the ship on the basis of a deviation between the set target bow direction of the ship and the actual bow direction detected during movement.

12. The ship control system according to claim 10, wherein, in the second operation mode, when the input device receives an input operation from the ship operator to move the ship forward or backward, and the actual bow direction of the ship is changing, the ship control device sets the actual bow direction at the time when the angular velocity of the actual bow direction of the ship becomes equal to or less than a threshold value as the target bow direction for moving the ship forward or backward.

13. The ship control system according to claim 10, wherein, when the input device has not received the input operation from the ship operator to move the ship forward or backward, the ship control device executes the bow direction holding control of the ship using an actual bow direction at a time when the input device has not received the input operation from the ship operator to move the ship forward or backward as a target bow direction.

14. A ship comprising:

an actuator that has a function of generating thrust of the ship and a function of generating a moment in the ship, and a first operation unit configured to receive an input operation from a ship operator; a ship control device configured to activate the actuator; and a bow direction detection unit configured to detect an actual bow direction of the ship, wherein the ship is communicable with an input device that is a separate communication device from the ship, is carried by the ship operator, and is capable of receiving an input operation from the ship operator from the outside of the ship; the input device including operation units for forward traveling, backward traveling, lateral moving, or turn/circle moving of the ship, and a communication unit configured to transmit the input operations to the ship; and, the ship control device includes a first operation mode and a second operation mode, a moment is generated in the ship on the basis of an input operation received by the first operation unit in the first operation mode, the actuator is activated on the basis of an input operation received by the input device in the second operation mode, and wherein, in the second operation mode, the ship control device is configured to:

in response to the input device starting to receive the input operation to move or turn/circle the ship to a target direction, automatically capture and set an actual bow direction detected by the bow direction detection unit at the time when the input operation is started as a target bow direction; and execute bow direction feedback control of the ship on the basis of a deviation between the target bow direction and the actual bow direction to automatically maintain the captured target bow direction without an instruction of the bow direction to the input device by the ship operator while the input operation to move the ship is being received.

15. A ship control method of controlling a ship including an actuator that has a function of generating thrust of the ship and a function of generating a moment in the ship, a first operation unit configured to receive an input operation from a ship operator, and a bow direction detection unit configured to detect an actual bow direction of the ship, the ship being communicable with an input device that is a separate communication device from the ship, is carried by the ship operator, and is capable of receiving an input operation from the ship operator from the outside of the ship, the input device including operation units for forward traveling, backward traveling, lateral moving, or turn/circle moving of the ship, and a communication unit configured to transmit the input operations to the ship; the method comprising:

a first operation in which a moment is generated in the ship on the basis of an input operation received by the first operation unit; and a second operation in which the actuator is activated on the basis of an input operation received by the input device, wherein, in the second operation, when the input device is receiving an input operation from the ship operator to move, turn around or circle the ship to a target direction, the ship control method comprises automatically capturing and seeting an actual bow direction detected by the bow direction detection unit at the time when the input operation is started as a target bow direction; and the ship control method comprises moving, turning, or circling the ship to the target direction received by the input device while executing bow direction feedback control of the ship is executed on the basis of a deviation between a target bow direction and an actual bow direction to automatically maintain the captured target bow direction, without an instruction for the bow direction to the input device from the ship operator while the input operation to move the ship is being received.

16. A non-transitory computer readable medium having recorded thereon statements and instructions in a machine-executable form causing a computer installed in a ship including an actuator that has a function of generating thrust of the ship and a function of generating a moment in the ship, and a first operation unit configured to receive an input operation from a ship operator, and a bow direction detection unit configured to detect an actual bow direction of the ship, the ship being communicable with an input device that is a separate communication device from the ship, includes operation units for forward traveling, backward traveling, lateral moving, or turn/circle moving of the ship, and a communication unit configured to transmit the input operations to the ship, is carried by the ship operator, and is capable of receiving an input operation from the ship operator from the outside of the ship, to execute:

a first operation in which a moment is generated in the ship on the basis of an input operation received by the first operation unit;

and a second operation in which the actuator is activated on the basis of an input operation received by the input device, wherein, in the second operation, when the input device is receiving an input operation from the ship operator to move, turn around, or circle the ship to a target direction, the statements and instructions cause the comptuer to automatically capture and set an actual bow direction detected by the bow direction detection unit at the time when the input operation is started as a target bow direction; and cause the computer to move, turn around, or circle the ship to the target direction received by the input device and to execute bow direction feedback control of the ship to automatically maintain the captured target bow direction on the basis of a deviation between a target bow direction and an actual bow direction of the ship in the second operation, without an instruction for the bow direction to the input device from the ship operator while the input operation to move the ship is being received.

* * * * *